United States Patent [19]

Arakawa et al.

[11] Patent Number: 4,575,635

[45] Date of Patent: Mar. 11, 1986

[54] RADIATION IMAGE STORAGE PANEL

[75] Inventors: Satoshi Arakawa; Terumi Matsuda, both of Kanagawa, Japan

[73] Assignee: Fuji Photo Film Co., Ltd., Kanagawa, Japan

[21] Appl. No.: 496,278

[22] Filed: May 18, 1983

[30] Foreign Application Priority Data

May 18, 1982 [JP] Japan ..... 57-82431

[51] Int. Cl.[4] ..... G21K 4/00

[52] U.S. Cl. ..... 250/484.1; 250/327.2

[58] Field of Search ..... 250/484.1, 487.1, 483.1, 250/327.2; 427/307, 308, 290

[56] References Cited

U.S. PATENT DOCUMENTS 2,900,271 8/1959 MacIntyre, Jr. et al. ..... 250/484.1
3,864,147 2/1975 Grunwald et al. ..... 427/307
4,239,968 12/1980 Kotera et al. ..... 250/327.2
4,264,408 4/1981 Benham ..... 313/372

FOREIGN PATENT DOCUMENTS 830778 3/1960 United Kingdom ..... 427/307

*Primary Examiner*—Alfred E. Smith
*Assistant Examiner*—Carolyn E. Fields
*Attorney, Agent, or Firm*—Murray, Whisenhunt and Ferguson

[57] ABSTRACT

A radiation image storage panel comprising a support and at least one phosphor layer comprising a binder and a stimulable phosphor dispersed therein. The sharpness of image provided by the storage panel and the adhesion between the phosphor layer and the support are both remarkably improved by providing the surface of support with a great number of pits having a mean depth of at least 1 μm, a maimum depth of more than 1 to 100 μm, and a mean diameter at the opening of at least 1 μm.

10 Claims, 2 Drawing Figures

RADIATION IMAGE STORAGE PANEL

Figure 1:
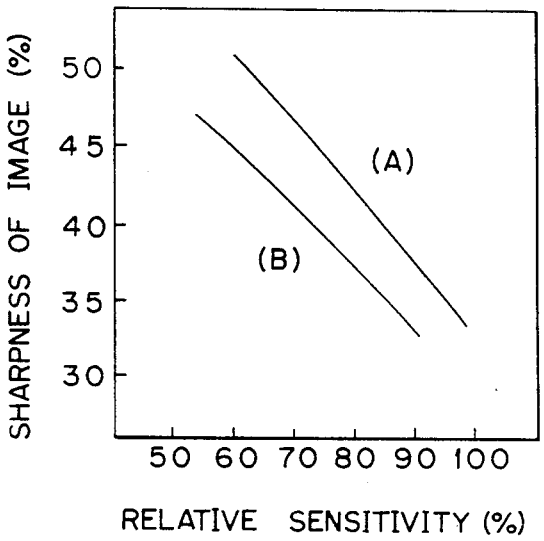

This invention relates to a radiation image storage panel and a process for the preparation of the same. More particularly, this invention relates to a radiation image storage panel comprising a support and at least one phosphor layer comprising a binder and a stimulable phosphor dispersed therein, and a process for the preparation of the same.

As a method of obtaining a radiation image, a radiation image recording and reproducing method described in U.S. Pat. Nos. 3,859,527, 4,258,264, 4,236,078, and 4,239,968 is paid much attention. In this radiation image recording and reproducing method, there is employed a radiation image storage panel comprising a stimulable phosphor which emits light when stimulated by an electromagnetic wave such as visible light and infrared rays (referred to hereinafter as "stimulating rays") after exposure to a radiation. The term "radiation" as used herein means an electromagnetic wave or a corpuscular radiation, such as X-rays, $\alpha$-rays, $\beta$-rays, $\gamma$-rays, high energy neutron rays, cathode rays, vacuum ultraviolet rays, or ultraviolet rays. The above-cited method involves steps of (1) causing the stimulable phosphor of the panel to absorb a radiation having passed through an object; (2) scanning the panel with stimulating rays to sequentially release the radiation energy stored in the panel as light emission; and (3) electrically processing the emitted light to give an image.

The radiation image recording and reproducing method using the stimulable phosphor requires far smaller radiation dose than the conventional radiography does, for obtaining a radiation image, and accordingly the former is very advantageous for the use in carrying out medical radiography for diagnosis.

The radiation image storage panel employable for carrying out the above-mentioned radiation image recording and reproducing method comprises a support and at least one phosphor layer comprising a binder and a stimulable phosphor dispersed therein. Further, a transparent film is generally provided onto the free surface of the phosphor layer to keep the phosphor layer from chemical and physical deterioration.

The stimulable phosphor is in the form of small particles. The stimulable phosphor particles absorb a radiation such as X-rays, and emit a light of high luminance when applied with an electromagnetic wave. In this procedure, the radiation energy transmitted through an object is absorbed by the stimulable phosphor layer in proportion to the dose of radiation energy, and a radiation image is formed as a radiation energy stored image on the radiation image storage panel. The stored image can be released in the form of light emission by stimulation with an electromagnetic wave (stimulating rays) such as visible light and infrared rays. The so emitted light is detected and processed electrically to reproduce an image from the radiation energy stored image.

The radiation image recording and reproducing method is, as described hereinbefore, very useful for forming an image. Naturally, the image reproduced in the method is required to have high sharpness. In the conventional radiography, the sharpness of image is determined by extent of spreading of the light emitted by a phosphor in the intensifying screen. In contrast, in the aforementioned radiation image recording and reproducing method, the sharpness of image is determined by extent of spreading of the stimulating rays within the panel, not by that of the light emitted by the phosphor in the panel. The reason is as follows: The image of radiation energy stored on the radiation image storage panel is detected sequentially, so that an amount of the light emitted by the stimulation in a certain period is recorded as an output from a number of phosphor particles in the panel having received the stimulating rays in the period. If the stimulating rays so scatter within the panel as to stimulate phosphor particles present outside the aimed phosphor particles, as well as the aimed particles, the output to be recorded corresponds not to that from the aimed phosphor particles, but to that from phosphor particles present in broader area.

In the radiation image storage panel consisting of a simple plane support, a stimulable phosphor layer, and a protective layer, the stimulating rays are apt to be scattered to wider region in the stimulable phosphor layer. It is, accordingly, difficult to obtain an image with high sharpness, and the improvement of radiation image storage panel is desired.

Further, the radiation image storage panel is ought to be so mechanically strong as to keep itself from separation between the support and the stimulable phosphor layer when subjected to mechanical shocks such as bending occuring in practical use of the panel. The radiation image storage panel is resistant to a radiation, as well as an electromagnetic wave for the stimulation such as visible light and infrared rays, whereby the panel is repeatedly employable for a long period. For this reason, the panel ought to be further resistant to mechanical shocks given in the procedures for forming a radiation image by applying the radiation and the electromagnetic wave, and in the procedure for handling of the radiation image storage panel comprising erasing the remaining radiation energy, so that it can be free from separation between the support and the stimulable phosphor layer.

Accordingly, a primary object of the present invention is to provide a radiation image storage panel improved in the sharpness, and a process for the preparation of the same.

Another object of the invention is to provide a radiation image storage panel improved in the mechanical strength, particularly, strength in the adhesion between the support and the stimulable phosphor layer, and a process for the preparation of the same.

There is provided by the invention a radiation image storage panel comprising a support and at least one stimulable phosphor layer comprising a binder and a stimulable phosphor dispersed therein, in which the support is provided on the surface facing the phosphor layer with a great number of pits having a mean depth of at least 1 $\mu$m, a maximum depth of more than 11 $\mu$m to 100 $\mu$m, and a mean diameter at the opening of at least 1 $\mu$m.

There is also provided by the invention a process for the preparation of a radiation image storage panel which comprises applying hard solid particles onto the surface of the support at high speed to provide a great number of pits having a mean depth of at least 1 $\mu$m, a maximum depth of more than 1 $\mu$m to 100 $\mu$m, and a mean diameter at the opening of at least 1 $\mu$m on the surface of the support, and providing thereon at least one stimulable phosphor layer comprising a binder and a stimulable phosphor dispersed therein.

FIG. 1 shows an example of the relationship between the sharpness and relative sensitivity observed in radiation image storage panels, in which A indicates a relationship observed in the panel according to the present invention, while B indicates a relationship observed in a conventional panel.

Figure 2:
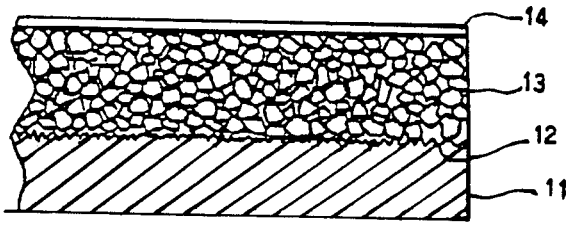

FIG. 2 shows a vertical section of a radiation image storage panel according to the present invention, in which 11 indicates a support having a great number of pits 12 on the surface, 13 indicates a phosphor layer, and 14 indicates a protective film.

The present invention is now described hereinafter more in detail.

According to the invention, an image formed on the radiation image storage panel is prominently improved in the sharpness, and the adhesion between the support and the phosphor layer is also remarkably improved by providing a great number of pits having the specifically determined size onto the surface of the support on the side facing the stimulable phosphor layer.

When a radiation such as X-rays having passed through an object enters into the stimulable phosphor layer (referred to, herein, as "phosphor layer") of a radiation image storage panel, the phosphor particles contained in the phosphor layer absorb the radiation energy to record on the phosphor layer a radiation energy stored image corresponding to the radiation energy having passed through the object. Then, when an electromagnetic wave (stimulating rays) such as visible light and infrared rays are impinged upon the radiation image storage panel, a phosphor particle having received the rays immediately emits light in a wavelength in the near ultra-violet region, releasing the radiation energy image stored on the phosphor layer. In the case of using a radiation image storage panel comprising a simply plane interface having no protrusions and depressions between the phosphor layer and the support, a part of the stimulating rays introduced into the phosphor layer and reaching the support surface undergoes mirror plane reflection by the support surface so as to spread widely within the phosphor layer. For this reason, phosphor particles present outside the aimed phosphor particles are also stimulated, and recorded is an output from phosphor particles in wider region than the output of the aimed phosphor particles. Accordingly, in the use of the storage panel comprising a support with such a plane surface, the sharpness of the image produced corresponding to the output signal is markedly deteriorated.

According to study of the present inventors, the deterioration of quality of image produced on the panel can be effectively prevented by providing the support surface with a great number of pits having the specifically determined size as defined above.

The reason for the improvement of the sharpness of image given by the image storage panel of the present invention can not be strictly explained. However, it is assumed that the improvement of the sharpness of image is given by the fact that the stimulating rays impinged upon the phosphor layer of the panel and reaching the interface between the phosphor layer and the support are likely substantially free from mirror reflection on the support surface having a great number of the specified pits. More in detail, the stimulating rays impinged upon the phosphor layer advance toward the support surface being absorbed by the phosphor particles dispersed in the phosphor layer, and a portion of the stimulating rays having been not absorbed by the phosphor reaches the support surface. If the support surface is of mirror plane, the rays are reflected diffusively under mirror reflection to reduce the sharpness of a radiation image formed in the phosphor layer. On the other hand, the rays reaching the support surface are substantially free from the mirror reflection, if the support surface has a great number of pits having appropriate dimensions. In this case, most of the reflected rays are presumably enclosed in the pits. Accordingly, reduction of the image sharpness is obviated in the latter case, and this means that the image sharpness provided by the image storage panel of the present invention is distinctly improved as compared with that provided by the image storage panel having no or inappropriate pits on the support surface.

The pits provided on the surface of the support, as described above, further serves for enhancing the adhesion between the support and the phosphor layer, so that substantially no separation takes place in a normal procedure for handling the image storage panel.

The radiation image storage panel of the present invention can be prepared in the manner as described below.

The support for constituting the image storage panel of the invention can be prepared by the use of material selected from those known or employed in the preparation of known image storage panels and various radiographic intensifying screens. Examples of the support material include plastic films such as films of cellulose acetate, polyester, polyethylene terephthalate, polyamide, polyimide, triacetate, and polycarbonate; metal sheets such as aluminum foil and aluminum alloy foil; ordinary papers; baryta paper; resincoated papers; pigment papers containing titanium dioxide or the like; and papers sized with polyvinyl alcohol or the like. In other words, there is no specific limitation on the material of the support, as far as the material can accept on the surface the formation of pits specified in the description given hereinbefore. In view of easiness in formation of these pits on the surface, as well as characteristics of a radiation image storage panel prepared therefrom, a plastic film is preferably employed as the support material. The plastic film may contain a light-absorbing material such as carbon black, or may contain a light-reflecting material such as titanium dioxide. The former is appropriate for preparing a high-sharpness image storage panel, while the latter is appropriate for preparing a high sensitive image storage panel.

In the preparation of a known radiation image storage panel, one or more of additional layers are optionally provided between the support and the phosphor layer. For instance, a subbing layer or an adhesive layer may be provided by coating a polymer material such as gelatin over the surface of the support on the side to receive the phosphor layer. Otherwise, a light-reflecting layer or a light-absorbing layer may be provided by introducing a polymer material layer containing a light-reflecting material such as titanium dioxide or a light-absorbing material such as carbon black, respectively.

A great number of the pits specified herein can be provided to the surface of support in an optionally chosen manner. Preferably, these pits are provided by a process comprising applying hard solid particles such as grits and sands onto the surface of support at high speed. The above-mentioned process is called "grit blasting" or "sand blasting". The hard solid particles can be applied onto the surface of support as such. Otherwise, a surface of an additional layer such as a subbing layer, light-reflecting layer, or light-absorbing layer, can be subjected to the high speed blasting of hard solid particles. The materials of the hard solid particles employable for the sand blasting or grit blasting are known in the art. For instance, metal particles, metal oxide particles, or other inorganic material particles can be employed. The size of the hard solid particles and the conditions for carrying out the above-mentioned process for the provision of the pits can be determined according to those known in the art.

The dimensions of the pits provided to the support surface are ought to be in ranges specified in the present invention for attaining the purposes of the invention.

If the pits provided to the support surface have dimensions substantially deviated from the ranges defined as in the present invention, the prominent improvement both in the sharpness of image and adhesion between the phosphor layer and the support are hardly attained.

More in detail, if the pits are smaller than those defined in the invention, not a small amount of the rays reaching the support surface are reflected under mirror reflection thereon, resulting in reduction of the image sharpness. Also unattainable is substantial enhancement of the adhesion between the phosphor layer and the support.

If the pits are larger than those defined in the invention, most of the rays reaching the support surface are reflected diffusively thereon and in turn are scattered in the phosphor layer, also resulting in reduction of the image sharpness. Moreover, large pits provided on the support surface sometimes disturb formation of the phosphor layer, or at least disturb formation of the phosphor layer of even thickness.

The pits provided to the support surface of the radiation image storage panel according to the present invention preferably have a mean depth of 1–10 μm, more preferably 1–5 μm; a maximum depth of more than 1–50 μm, more preferably 2–20 μm, and a mean diameter at the opening of 1–100 μm, more preferably 10–50 μm. The radiation image storage panel provided on the support surface with a great number of pits as specified above is particularly improved in the image sharpness and the adhesion between the phosphor layer and the support.

On the support surface provided with a great number of the pits is formed the phosphor layer.

The phosphor layer comprises a binder and a stimulable phosphor in the form of small particles dispersed therein.

Examples of the stimulable phosphors employable in the present invention include the following phosphors.

(i) SrS:Ce,Sm, SrS:Eu,Sm, $La_2O_2S$:Eu,Sm, and (Zn,Cd)S:MnX wherein X is halogen, as described in U.S. Pat. No. 3,859,527;

(ii) ZnS:Cu,Pb, $BaO.xAl_2O_3$:Eu wherein x is a number satisfying the condition of $0.8 \leqq x \leqq 10$, and $M^{II}O.xSiO_2$:A wherein $M^{II}$ is at least one divalent metal selecting from the group consisting of Mg, Ca, Sr, Zn, Cd and Ba, A is at least one element selected from the group consisting of Ce, Tb, Eu, Tm, Pb, Tl, Bi and Mn and x is a number satisfying the condition of $0.5 \leqq x \leqq 2.5$, as described in U.S. Pat. No. 4,236,078;

(iii) LnOX:xA wherein Ln is at least one element selected from the group consisting of La, Y, Gd and Lu, X is Cl and/or Br, A is Ce and/or Tb, and x is a number satisfying the condition of $0 < x \leqq 0.1$, as described in the above-mentioned U.S. Pat. No. 4,236,078;

(iv) $(Ba_{1-x},M^{II}x)Fx$:yA wherein $M^{II}$ is at least one divalent metal selected from the group consisting of Mg, Ca, Sr, Zn and Cd, X is at least one halogen selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.1$, respectively, as described in U.S. Pat. No. 4,239,968;

(v) $(Ba_{1-x-y},Mg_x,Ca_y)FX$:a$Eu^{2+}$ wherein X is at least one halogen selected from the group consisting of Cl, Br and I, x and y are numbers satisfying the conditions of $0 < x+y \leqq 0.6$ and $xy \neq 0$, and a is a number satisfying the condition of $10^{-6} \leqq a \leqq 5 \times 10^{-2}$, as described in Japanese Patent Provisional Publication No. 55(1980) 12143 and U.S. patent application Ser. No. 57,080, now abandoned;

(vi) BaFX:xCe,yA wherein X is at least one halogen selected from the group consisting of Cl, Br and I, A is at least one element selected from the group consisting of In, Ta, Gd, Sm and Zr, and x and y are numbers satisfying the conditions of $0 < x \leqq 2 \times 10^{-1}$ and $0 < y \leqq 5 \times 10^{-2}$, respectively, as described in U.S. Pat. No. 4,261,854;

(vii) $BaF_2.aBaX_2.bMe^{I}F.cMe^{II}F_2.dMe^{III}F_3$. eLn wherein X is at least one halogen selected from the group consisting of Cl, Br and I, $Me^{I}$ is Li and/or Na, $Me^{II}$ is at least one divalent metal selected from the group consisting of Be, Ca and Sr, $Me^{III}$ is at least one trivalent metal selected from the group consisting of Al, Ga, Y and La, Ln is at least one element selected from the group consisting of Eu, Ce and Tb, and a, b, c, d and e are numbers satisfying the conditions of $0.90 \leqq a \leqq 1.05$, $0 \leqq b \leqq 0.9$, $0 \leqq c \leqq 1.2$, $0 \leqq d \leqq 0.03$, $10^{-6} \leqq e \leqq 0.03$, respectively and $b=c=d \neq 0$, as described in Japanese Patent Provisional Publication No. 56(1981)-2385;

(viii) complex halide phosphor in which $MgF_2$ is added to the above-mentioned phosphor of Japanese Patent Provisional Publication No. 56(1981)-2385, as described in Japanese Patent Provisional Publication No. 56(1981)-2386;

(ix) BaFX.aLiX'.bBeX''.c$M^{III}X'''_3$:dA wherein each of X, X', X'' and X''' are at least one halogen selected from the group consisting of Cl, Br and I, $M^{III}$ is Al and/or Ga, A is at least one element selected from the group consisting of Eu, Tb, Ce, Tm, Dy, Pr, Ho, Nd, Yb, Eu, Gd, Lu, Sm and Y, and a, b, c and d are numbers satisfying the conditions of $0 \leqq a \leqq 0.1$, $0 \leqq b \leqq 0.1$, $0 \leqq c \leqq 0.1$, $10^{-6} \leqq d \leqq 0.2$, respectively and $0 \leqq a+b+c \leqq 0.1$, as described in Japanese Patent Provisional, Publication No. 56(1981)-74175 and U.S. patent application Ser. No. 657,063; and the like.

The stimulable phosphor preferably is a divalent europium activated complex halide phosphor. Out of the divalent europium activated complex halide phosphor, a divalent europium activated alkaline earth metal fluorohalide phosphor is preferred. Out of the divalent europium activated alkaline earth metal fluorohalide phosphor, a divalent europium activated barium fluorohalide phosphor is preferred. Out of the divalent europium activated barium fluorohalide phosphor, a divalent europium activated barium fluorobromide ($BaFBr:Eu^{2+}$) phosphor is particularly preferred.

From the viewpoint of practical use, the stimulable phosphor preferably is a phosphor which emits light in the wavelength region ranging from 300 nm to 600 nm when stimulated by stimulating rays in the wavelength region ranging from 450 nm to 1100 nm, particularly from 450 nm to 750 nm.

Examples of the binder contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polymethyl methacrylate, vinyl chloride-vinyl acetate copolymer, polyurethane, cellulose acetate butyrate, polyvinyl alcohol, and linear polyester. Particularly preferred binders are nitrocellulose, linear polyester, and a mixture of nitrocellulose and linear polyester.

The phosphor layer can be formed on the support in the following procedure.

The phosphor particles and binder are mixed in the presence of an appropriate amount of a solvent to prepare a coating dispersion containing the phosphor particles dispersed homogeneously in the binder solution. Examples of the solvent employable in the preparation of the coating dispersion include lower alcohols such as methanol, ethanol, n-propanol, and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate, and butyl acetate; ethers such as dioxane, ethylene glycol monoethylether, and ethylene glycol monomethylether; and mixtures of the above-mentioned compounds.

The radio between the binder and the phosphor in the coating dispersion may be determined according to the aimed characteristics of the radiation image storage panel and nature of the phosphor employed. Generally, the ratio therebetween is in the range of from 1 : 1 to 1 : 100 (binder : phosphor, by weight), preferably 1 : 8 to 1 : 40.

The coating dispersion may contain a dispersing agent for assisting dispersion of the phosphor particles in the solution, a plasticizer for increasing the adhesion between the binder and the phosphor particles in the phosphor layer, and/or other additives. Examples of the dispersing agent include phthalic acid, stearic acid, capric acid, and hydrophobic surface active agents. Examples of the plasticizer include phosphates such as triphenyl phosphate, tricresyl phosphate, and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and binder prepared as above is coated evenly over the surface of the support provided with a great number of the pits having the specific size. The coating procedure can be carried out by a conventional method such as a method using a doctor blade, roll coater, or knife coater.

The so coated layer is then heated slowly to dryness, so as to complete the formation of the phosphor layer on the support. The thickness of the phosphor layer varies depending upon the aimed characteristics of the image storage panel, nature of the phosphor particles, the ratio between the binder and the phosphor particles, etc. Generally, the thickness of the phosphor layer is in the range of from 20 μm to 1 mm. The thickness in the range of 50–500 μm is preferred.

The phosphor layer can be provided onto the support in a different manner. For instance, the phosphor layer is independently prepared on a sheet such as a glass plate, metal plate, or plastic sheet, by the use of the aforementioned coating dispersion. The so prepared phosphor layer is then transferred onto the support by pressing the phosphor layer thereonto or laminating the phosphor layer on the support by the use of an adhesive agent.

As mentioned hereinbefore, the radiation image storage panel of the present invention may have a transparent film on the surface of the phosphor layer to protect the phosphor layer from physical and chemical deterioration.

The transparent film can be provided onto the phosphor layer by coating the surface of the phosphor layer with a polymer solution containing a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer). Otherwise, a transparent film prepared independently from polyethylene terephthalate, polyethylene, polyvinylidene chloride, polyamide or the like can be placed and fixed on the support by the use of an appropriate adhesive agent to provide the protective film. The transparent protective film preferably has a thickness in the range of approximately 2–20 μm.

The present invention is further described by the following examples, which are by no means intended to restrict the invention.

EXAMPLE 1

A surface of a polyethylene terephthalate film containing carbon black (support, thickness 250 μm) was subjected to sand blasting employing silica sand in which more than approximately 50% by weight of the silica particles had 100–150 mesh size. The sand blasting was carried out under centrifugal force by applying to the support surface the silica particles supplied from a drum rotating at a speed of 1900 r.p.m. Thus, a rough surface was provided onto the support. The so prepared surface of the support was provided with a great number of pits having a mean depth of 2 μm, a maximum depth of 7 μm, and a mean diameter at the opening of 20 μm.

Independently, to a mixture of a particulated divalent europium activated barium fluorobromide ($BaFBr:Eu^{2+}$) stimulable phosphor and a linear polyester resin were successively added methyl ethyl ketone and nitrocellulose (nitrofication degree 11.5%) to prepare a phosphor dispersion. To the phosphor dispersion were further added tricresyl phosphate, n-butanol and methyl ethyl ketone. The mixture was sufficiently stirred by means of a propeller agitater to obtain a homogeneous coating dispersion having a viscosity of 25–35 PS (at 25° C.).

The coating dispersion was applied to the sandblasted surface of the support placed horizontally on a glass plate. The coating procedure was carried out using a doctor blade. The support coated with the dispersion thereon was then placed in an oven and heated therein at a temperature slowly varying from 25° to 100° C. Thus, a phosphor layer having thickness of approximately 180 μm was produced on the support.

On the phosphor layer of the support was placed a transparent polyethylene terephthalate film (thickness:

12 μm; having a polyester adhesive layer) to combine the transparent film and the phosphor layer through the adhesive layer.

Thus, a radiation image storage panel consisting of a support, a phosphor layer and a transparent protective film was prepared.

COMPARISON EXAMPLE 1

The procedure of Example 1 was repeated except that the sand blasting to the surface of the support was carried out using silica sand in which more than approximately 50% by weight of the silica particles had approximately 300 mesh size. The so processed surface of the support was provided with a great number of pits having a mean depth of 0.2 μm, a maximum depth of 0.8 μm, and a mean diameter at the opening of 0.5 μm.

A radiation image storage panel consisting of a support, a phosphor layer and a transparent protective film was then prepared in the same manner as described in Example 1.

The radiation image storage panels prepared in Example 1 and Comparison Example 1 were evaluated on the sharpness of image and the adhesion strength of the phosphor layer to the support. The evaluation methods are given below:

(1) Sharpness of image

The panel was exposed to X-rays of 80 KVp through an MTF chart made of lead, and subsequently the panel was scanned with a He-Ne laser beam. The light emitted by the phosphor layer of the panel was detected and converted to the corresponding electric signal by means of the above-mentioned photosensor. The electric signal was converted to the corresponding image signal by means of an analogue-digital converter, and the image signal was recorded on a magnetic tape. The magnetic tape was then analyzed in a computer to produce the modulation transfer function (MTF) of the X-ray image recorded thereon. The MTF value was produced and given as an MTF value (%) at the spacial frequency of 2 cycle/mm.

(2) Adhesion strength of phosphor layer to support

The panel was cut to give a test strip (1 cm×6 cm) and an adhesive polyester tape was stuck on the protective film of the support. The so prepared test strip was then given on the adhesive tape side a U-shaped cut having a depth reaching the interface between the phosphor layer and the support by means of a knife. The U-shaped cut was made along the longitudinal direction of the strip.

In a tensile testing machine (Tensilon UTM-11-20 manufactured by Toyo Baldwin Co., Ltd., Japan), the U-shaped cut portion and the remaining strip portion were forced to separate from each other by pulling up the tab end of the cut portion at a rate of 2 cm/min. The adhesion strength was determined just when a 1-cm long portion of the phosphor layer was separated from the support. The strength is expressed in terms of the force F (g/cm).

The results are set forth in Table 1. A relative sensitivity is also set forth in Table 1.

TABLE 1

| | Ex. 1 | Com. Ex. 1 |
|---|---|---|
| Sharpness | 0.41 | 0.36 |
| Adhesion strength | 170 | 75 |
| Relative sensitivity | 84 | 85 |

EXAMPLE 2

The procedure of Example 1 was repeated except that the phosphor layer was formed in thickness of 200 μm, to prepare a radiation image storage panel consisting of a support, a phosphor layer and a transparent protective film.

COMPARISON EXAMPLE 2

The procedure of Comparison Example 1 was repeated except that the phosphor layer was formed in thickness of 200 μm, to prepare a radiation image storage panel consisting of a support, a phosphor layer and a transparent protective film.

Each of the panel prepared in Example 2 and Comparison Example 2 was evaluated on the sharpness of image and the adhesion strength of the phosphor layer to the support in the same manner described previously. The results are set forth in Table 2.

TABLE 2

| | Ex. 2 | Com. Ex. 2 |
|---|---|---|
| Sharpness | 0.50 | 0.44 |
| Adhesion strength | 170 | 75 |
| Relative sensitivity | 59 | 63 |

EXAMPLE 3

The procedure of Example 1 was repeated except that the polyethylene terephthalate film containing carbon black was replaced with a polyethylene terephthalate film having the same thickness but containing titanium dioxide, to prepare a radiation image storage panel consisting of a support, a phosphor layer and a transparent protective film.

COMPARISON EXAMPLE 3

The procedure of Comparison Example 1 was repeated except that the polyethylene terephthalate film containing carbon black was replaced with a polyethylene terephthalate film having the same thickness but containing titanium dioxide, to prepare a radiation image storage panel consisting of a support, a phosphor layer and a transparent protective film.

Each of the panels prepared in Example 3 and Comparison Example 3 was evaluated on the sharpness of image and the adhesion strength of the phosphor layer to the support in the same manner described previously. The results are set forth in Table 3.

TABLE 3

| | Ex. 3 | Com. Ex. 3 |
|---|---|---|
| Sharpness | 0.33 | 0.29 |
| Adhesion strength | 170 | 75 |
| Relative sensitivity | 97 | 100 |

EXAMPLE 4

The procedure of Example 1 was repeated except that the thickness of the phosphor layer was varied in the range of 200–300 μm, to prepare a radiation image storage panel consisting of a support, a phosphor layer and a transparent protective film.

COMPARISON EXAMPLE 4

The procedure of Example 4 was repeated except that no sand blasting was applied to the surface of the support, to prepare a radiation image storage panel consisting of a support, a phosphor layer and a transparent film.

The sharpness of image was evaluated on a variety of the panels prepared in Example 4 and Comparison Example 4. The results are illustrated graphically in FIG. 1.

In FIG. 1, the relationship between the sharpness and the relative sensitivity observed in the panels prepared in Example 4 is given under the indication A, while the relationship therebetween observed in the panels prepared in Comparison Example 4 is given under the indication B.

From the results given in FIG. 1, the radiation image storage panel of the present invention shows prominently higher sharpness of image than the radiation image storage panel prepared according to the conventional method, under the conditions that the sensitivity is set at the same value.

We claim:

1. A radiation image storage panel comprising a support and at least one phosphor layer comprising a binder and a stimulable phosphor dispersed therein, in which the support is provided on the surface facing the phosphor layer with a great number of pits having a mean depth of at least 1 μm, a maximum depth of more than 1 μm to 100 μm, and a mean diameter at the opening of at least 1 μm.

2. The radiation image storage panel as claimed in claim 1, in which the pits have a mean depth of 1–10 μm, a maximum depth of more than 1–50 μm, and a mean diameter at the opening of 1–100 μm.

3. The radiation image storage panel as claimed in claim 2, in which the pits have a mean depth of 1–5 μm, a maximum depth of 2–20 μm, and a mean diameter at the opening of 10–50 μm.

4. The radiation image storage panel as claimed in any one of claims 1 through 3, in which the support is made of a plastic film.

5. The radiation image storage panel as claimed in any one of claims 1 through 3, in which the binder comprises a linear polyester as a principal component.

6. The radiation image storage panel as claimed in any one of claims 1 through 3, in which the binder comprises nitrocellulose as a principal component.

7. The radiation image storage panel as claimed in any one of claims 1 through 3, in which the binder comprises a mixture of a linear polyester and nitrocellulose as a principal component.

8. The radiation image storage panel as claimed in any one of claims 1 through 3, in which the stimulable phosphor is a divalent europium activated alkaline earth metal fluorohalide.

9. A process for the preparation of a radiation image storage panel comprising a support and at least one phosphor layer comprising a binder and a stimulable phosphor dispersed therein, in which the support is provided on the surface facing the phosphor layer with a great number of pits having a mean depth of at least 1 μm, a maximum depth of more than 1 μm to 100 μm, and a mean diameter at the opening of at least 1 μm, which comprises applying hard solid particles onto the surface of support at high speed to form the pits.

10. A process as claimed in claim 9, in which the support is made of a plastic film.

* * * * *